US008272427B2

(12) United States Patent
Hanse

(10) Patent No.: US 8,272,427 B2
(45) Date of Patent: Sep. 25, 2012

(54) REUSABLE CASTING MEMBER

(75) Inventor: Eric Hanse, Orches (FR)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

(21) Appl. No.: 13/130,112

(22) PCT Filed: Nov. 19, 2009

(86) PCT No.: PCT/EP2009/008242

§ 371 (c)(1),
(2), (4) Date: Jun. 13, 2011

(87) PCT Pub. No.: WO2010/057638

PCT Pub. Date: May 27, 2010

(65) Prior Publication Data

US 2011/0226438 A1 Sep. 22, 2011

(30) Foreign Application Priority Data

Nov. 20, 2008 (EP) ..... 08169498

(51) Int. Cl.
*B22D 11/10* (2006.01)

(52) U.S. Cl. ..... 164/488; 164/437

(58) Field of Classification Search ..... 164/488–489, 164/437–438, 337, 133; 222/606–607
See application file for complete search history.

(56) References Cited

U.S. PATENT DOCUMENTS

2011/0240246 A1* 10/2011 Boisdequin ..... 164/76.1

FOREIGN PATENT DOCUMENTS

| | | | |
|---|---|---|---|
| EP | 0858851 | A | 8/1998 |
| JP | 7080610 | A | 3/1995 |
| KR | 20040021971 | A | 3/2004 |

OTHER PUBLICATIONS

Ramos-Banderas A et al: "Dynamics of two-phase downward flows in submerged entry nozzles and its influence on the two-phase flow in the mold"; International Journal of Multiphase Flow, Elsevier, Amsterdam, NL, vol. 31, No. 5, May 1, 2005, pp. 643-665, XP004864645 ISSN: 0301-9322, abstract, paragraph [03.2]; Figs 4-7, paragraph [Conclusions].

(Continued)

*Primary Examiner* — Kuang Lin
(74) *Attorney, Agent, or Firm* — Thomas Clinton; Donald M. Satina

(57) ABSTRACT

A casting element for a casting installation for transferring liquid metal comprises a plurality of casting elements in successive contact and forming a canal along which the metal can flow, the casting element comprising a tube, notably a ladle shroud, the axis of which corresponds to the axis of the canal. The casting element is able to make contact with an upstream element of the installation and comprises means for controlling the angular orientation of the tube about its axis with respect to the upstream element, these means being capable of giving the tube at least three distinct orientations.

10 Claims, 2 Drawing Sheets

OTHER PUBLICATIONS

Binns R et al: "Electromagnetic Techniques for Imaging the Cross-Section Distribution of Molten Steel Flow in the Continuous Casting Nozzle", IEEE Sensors Journal, IEE Service Center, New York, NY, US, vol. 5, No. 2 Apr. 1, 2005, pp. 224-232, XP011128744, ISSN: 1530-437X, abstract, col. 2, line 5-line 19, paragraph [Conclusion].

Binns R et al: "Imaging molten steel flow profiles; Imaging molten steel profiles", Measurement Science and Technology, IOP, Bristol, GB, vol. 12, No. 8, Aug. 1, 2001, pp. 1132-1138, XP20063257, ISSN: 0957-0233, abstract , paragraph [Discussion]; Figures 2, 5.

Higson S-R et al.: "Development of a sensor for visualization of steel flow in the continuous casting nozzle", Revue De Metallurgie Rev. Metall France, vol. 100, No. 6, Jun. 2003, pp. 629-632, XP002517028, ISSN: 0035-1563, the whole document.

* cited by examiner

REUSABLE CASTING MEMBER

BACKGROUND OF THE INVENTION (1) Field of the Invention

The present invention relates to an installation for casting liquid metal, notably a continuous casting installation.

(2) Description of the Related Art

A casting installation for transferring liquid metal, notably liquid steel, is already known in the prior art and comprises a ladle of liquid metal downstream of which there is arranged a ladle shroud which is a cylinder of revolution. This shroud comprises an upper end in contact with a casting element secured to the ladle and a lower end submerged in a tundish. A canal extending essentially along an axis, placed vertically when the tube is introduced into the installation, is formed in the shroud.

One method of casting is performed as follows using the casting installation: the ladle is positioned over the tundish, and the shroud is fitted to the ladle. The casting operations are then performed, then the shroud is detached from the ladle. Next, the ladle is moved so that it leaves free space above the tundish. Another ladle then arrives to take the place of the first one. The ladle shroud can be reused and, to do this, it is secured to another ladle. The shroud is placed in any arbitrary angular orientation with respect to each ladle.

In this method, despite the fact that the shroud is reused, the life of this shroud is not very long given the extreme conditions under which it is positioned (high temperature, substantial temperature variations, etc.). Thus, one single shroud can be used only a limited number of times.

BRIEF SUMMARY OF THE INVENTION

It is an object of the invention to provide a casting element, notably comprising a ladle shroud that has a longer life.

To this end, the subject of the invention is a casting element for a casting installation for transferring liquid metal comprising a plurality of casting elements in successive contact and forming a canal, extending essentially along its axis, along which the metal can flow, the casting element comprising a tube, notably a ladle shroud, the axis of which corresponds to the axis of the canal, the element being able to make contact with an upstream element of the installation and comprising means for controlling the angular orientation of the tube about its axis with respect to the upstream element, these means being capable of giving the tube at least three distinct orientations.

Thus, the casting element, notably the ladle shroud, can be introduced under the ladle in one or more predetermined orientations. As a result, each time the shroud is reused, the angular orientation in which it is placed relative to the upstream element of the installation can be controlled, possibly according to angular orientations in which it has been placed in previous uses.

This then makes it possible to obtain more even wear on the inside of the tube. Specifically, the flow leaving a steel casting ladle is slightly oriented especially when, between the ladle and the ladle shroud, there is a well known "slide valve" comprising an opening that can be partially closed off at the time of casting. When this opening is in a partially closed-off position, the flow of liquid metal follows a sinusoidal movement: it is directed more particularly towards a given portion of an internal wall of the shroud, on which it is so to speak reflected to be directed towards an opposite portion of the wall, etc. Now, those portions of the internal wall of the ladle shroud towards which the flow is directed wear more rapidly than the rest of this wall, because of the high temperature to which the liquid metal is raised. Thus, by distributing those portions of the wall that are most likely to become worn as a function of use, the internal wear of the wall of the tube can be made more uniform and the tube does not have to be scrapped because just one portion of its internal wall has become very badly worn by comparison to the rest (such a configuration being possible when the orientation of the tube is a random one). The life of the tube is therefore lengthened.

Furthermore, thanks to the means of controlling the orientation, it is easy to orient the stream of liquid metal because the position in which the tube is to be placed in the installation is known exactly. It therefore becomes possible for example for the tube to be fitted with openings so that the stream flows through the tundish in one or more favoured directions. That makes it possible to provide the casting efficiency.

The invention may also comprise one or more of the features contained in the list below:

the control means are capable of giving the tube four distinct orientations, notably spaced 90° apart. This embodiment is a preferred embodiment of the invention because it allows optimum tube life. Specifically, such means allows the entire internal wall of the tube to be used while minimizing areas of overlap, which are portions likely to receive the stream when the casting element is positioned in two distinct orientations. By contrast, if the orientation control means are formed in such a way that they allow the tube to be introduced into the installation in a number of orientations greater than 4 (this embodiment also being covered by the invention), the areas of overlap will become worn for two distinct angular orientations of the tube. These areas of overlap will therefore reach a critical wear threshold before the rest of the internal wall and the tube will be scrapped even though a large proportion of the internal wall of the tube is still able to accept the stream without any risk. The embodiment explained hereinabove therefore makes it possible to optimize the life of the tube;

the tube, at an end corresponding to one end of the canal, has a surface capable of making contact with the upstream element, this surface being planar. In this case, the tube is placed against the installation comprising the ladle, more particularly against the valve situated downstream thereof, by sliding (rather than by a push fit). The casting element according to the invention therefore has an additional advantage in that because the tube slides with respect to the upstream element, the contact surface thereof generally suffers localized wear, the damaged region corresponding to the region situated in the vicinity of the diameter of the tube which is parallel to the direction of sliding of the tube relative to the upstream element. Thus, when the orientation of the tube relative to the upstream element is changed when the tube is reused, the wear on the surface in contact with the upstream element is also spread evenly. That prevents the tube from cracking at this surface and also contributes towards optimizing the life thereof;

the casting element comprises a removable frame that can be placed around the tube. This removable frame in some instances reinforces the tube and holds it in place in the casting installation by collaboration between the frame and a support;

the control means comprise at least one abutment surface formed on the tube and/or the frame and capable of collaborating with at least one complementary surface belonging notably to a support capable of keeping the element in contact with the upstream element of the installation. In particular, the abutment surface may be the surface of a housing (or notch) capable of collaborating with a projection of the support or a surface of a projection capable of collaborating with a housing (or notch) of the support;

the control means comprise abutment surfaces formed, on the one hand, on the tube and, on the other hand, on the frame, and able to collaborate. In this case, the frame comprises means for orientating the frame in a single orientation in the support whereas the tube can be orientated in several orientations in the frame;

the end of the tube comprising the contact surface is configured to have at least one radial distinctive feature, the control means being arranged on the periphery of the tube in at least one portion of the tube that forms the distinctive feature. This configuration makes it easier for the tube to be fitted to the support or into the frame by the operator or by a robot. Specifically, these radial distinctive features make it easier for the abutment surface of the frame and/or that of the support to be brought into register with that of the tube;

in particular, the tube has at least two radial distinctive features, each distinctive feature being a projection ending in the axial direction of the tube in a chamfered surface, at a distance from the contact surface. The chamfered surface is notably capable of collaborating with a surface of complementary shape belonging to the frame, against which it can rest. In this case, the angular orientation means are arranged so that the direction of sliding of the tube does not correspond, in any orientation, to a direction in which the radial distinctive feature or features extends or extend. This embodiment is advantageous because the regions of the contact surface of the tube which experience the stresses are therefore regions thereof that are in compression. Compression loading of these regions takes effect because the chamfered surfaces rest against the complementary surfaces of the frame. This embodiment makes it possible to avoid the formation of open cracks on the contact surface and further lengthen the life of the tube.

Another subject of the invention is a casting installation for transferring metal comprising a plurality of casting elements in successive contact forming a canal along which the liquid metal can flow, the installation comprising a casting element according to the invention.

A further subject of the invention is a method for casting in a plurality of casting installations for transferring metal, each installation comprising a plurality of casting elements in successive contact forming a canal along which the metal can flow, the method using a casting element according to the invention, and comprising the following steps:

the casting element is introduced so that the tube is placed in a first orientation about its axis with respect to an upstream element of a first installation, the casting operations are performed, the casting element is removed from the first installation, the previous three steps are repeated with the casting element placed respectively in a second and then in a third installation so that the tube is placed respectively in a second and then in a third orientation about its axis with respect to an upstream element of the second and the third installation.

BRIEF DESCRIPTION OF THE SEVERAL VIEWS OF THE DRAWINGS

The invention will be better understood from reading the description which will follow, which is given solely by way of example and made with reference to the drawings in which.

DETAILED DESCRIPTION OF THE INVENTION

Figure 1:
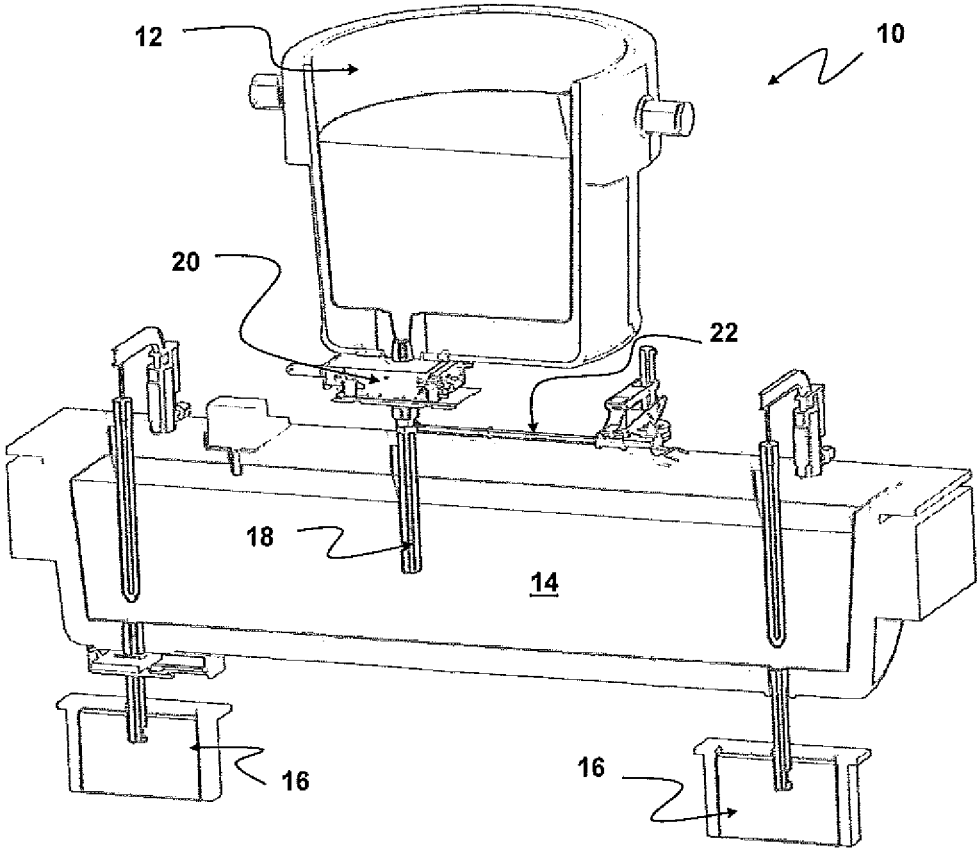
FIG. 1 is a schematic cross section through a casting installation according to one particular embodiment of the invention.

FIG. 1 depicts a casting installation 10 according to one particular embodiment of the invention. The casting installation notably comprises a casting component or ladle 12 storing the liquid metal and a tundish 14 giving the liquid metal access to casting moulds 16.

The ladle 12 can be moved, while the tundish 14 and the moulds 16 are fixed. Thus, when the ladle 12 is empty, it is moved away from the tundish 14 leaving the space above the tundish free. Another, full, ladle is then brought into the position provided for that purpose above the tundish 14.

To allow the liquid metal to pass between the ladle 12 and the tundish 14, the installation 10 also comprises a casting element comprising a casting component or ladle shroud 18 which has a canal along which the metal can flow, this canal extending essentially along an axis, which when the shroud 18 is in its position of use is vertical.

As can be seen in FIG. 1, the shroud 18, when in its position of use, comprises a surface for contact with the upstream casting element, in this instance a casting component or slide valve 20 secured to the ladle 12. Its lower end on the other hand is immersed in the tundish 14. More specifically, at its upper end the shroud 18 comprises a surface for contact with the valve 20, this surface being planar and allowing the shroud to be positioned in the installation 10 by sliding. For that purpose, the shroud is supported and held during casting by an arm 22 external to the installation.

The casting installation is not restricted to that which has been described hereinabove.

For example, it is possible to imagine there being just one casting mould 16 under the tundish. The shroud could also be fitted into the installation as a push fit rather than by sliding. Further, the ladle is not necessary fitted with a slide valve. It could be fitted with a valve of some other type.

It is also conceivable for the device that holds the shroud in contact with the slide valve 20 to belong to the ladle and to be formed notably of an H-shaped support, holding the shroud and the ladle together.

A casting element according to a first embodiment of the invention will now be described.

Figure 2:
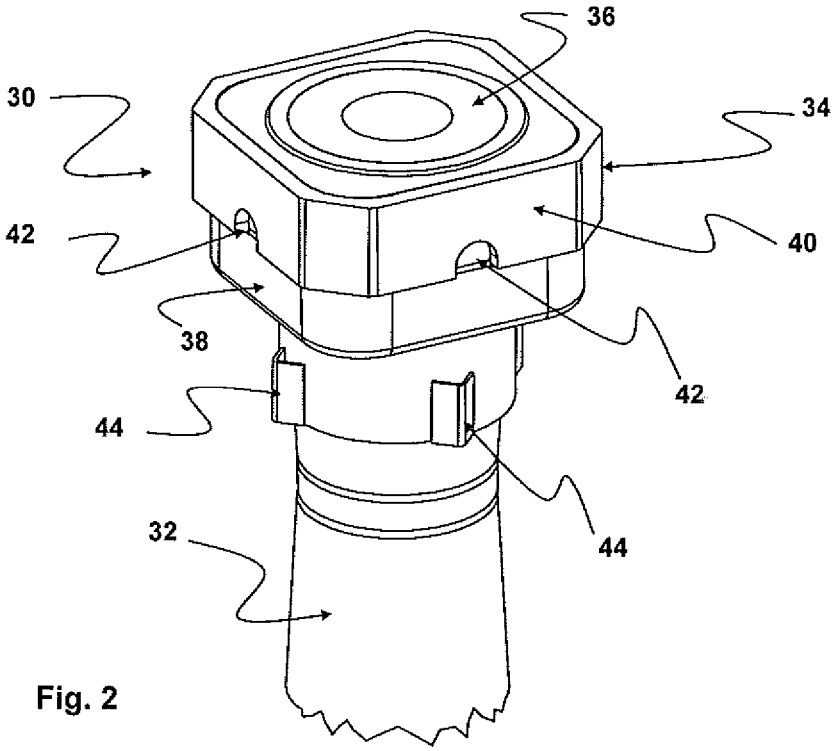
FIG. 2 is a perspective view of a pouring tube according to one particular embodiment of the invention.

FIG. 2 notably depicts a casting element that forms a ladle shroud for the casting installation of FIG. 1, FIG. 2 more specifically showing an upper end of the shroud.

A casting element 30, in this instance a shroud, comprises a tube body 32 made of a refractory material and in the form of a cylinder of circular cross section. The shroud, at its upper end, comprises a head 34 of square cross section and ends in a planar contact surface 36 able to come into contact with an upstream element of the installation, such as the slide valve 20. Such a shroud is installed in the installation by sliding as already explained earlier.

Further, as may be seen from FIG. 2, the shroud comprises a jacket 38, made as a single piece and formed around an end portion of the shroud, this portion notably comprising the head 34 and a tubular portion of the shroud. The jacket 38 is made of a metallic material, notably of steel.

This jacket 38 comprises an annular portion 40 forming around the jacket a belt of greater thickness than the rest of the jacket. The thickness of the belt is notably greater than 10 millimeters and preferably than 14 millimeters. Further, control means or notches 42 are formed in the belt 40, more particularly in the lower portion thereof.

The shroud comprises four notches 42 each situated on one side of its square head in the middle of each side of the head. In the figures, only two notches have been depicted. The notches are spaced 90° apart, that is to say that when the shroud is rotated through 90° about the axis of the canal, the head of the shroud is identical to how it looked before the rotation.

The surfaces of two notches 42 situated on opposite sides of the head form abutment surfaces intended to collaborate with complementary surfaces of two pins (not depicted) of a support of the installation holding the head, such as the manipulator arm 22, and allow the shroud to be held in the support.

Further, these abutment surfaces also form means of controlling the angular orientation of the shroud. Specifically, they allow the shroud to be positioned on the support in a determined orientation relative to the axis of the canal of the shroud.

Further, because the head of the shroud is unchanging when subjected to a rotation through 90°, the shroud can be positioned in four distinct orientations in the support because one and the same pin belonging to the support can receive all four notches 42 of the shroud, thus giving the shroud four distinct orientations relative to the upstream element, namely the valve 20 of the installation.

This is particularly advantageous because it allows the wear of the internal wall of the shroud and the wear of the contact surface 36 thereof to be suitably distributed.

The metallic jacket 38 of the shroud further comprises four fins 44, in its portion that covers the tubular portion of the shroud. These fins are identical and extend essentially along the axis of the canal. They are of unvarying and triangular cross section. Each fin 44 is situated under one of the notches 42. The fins 44 are therefore spaced 90° apart.

The fins 44 allow the shroud 18 to be placed in a handling device capable of moving the shroud to the support. The fins 44 are notably intended to collaborate with the complementary notches of the handling device. Because the shroud comprises several fins 44 evenly when distributed about a circumference thereof, it can be placed in the handling device in several orientations relative to the axis of the canal, and this makes it easier for the shroud to be placed in the desired orientation relative to the support.

Figure 3:
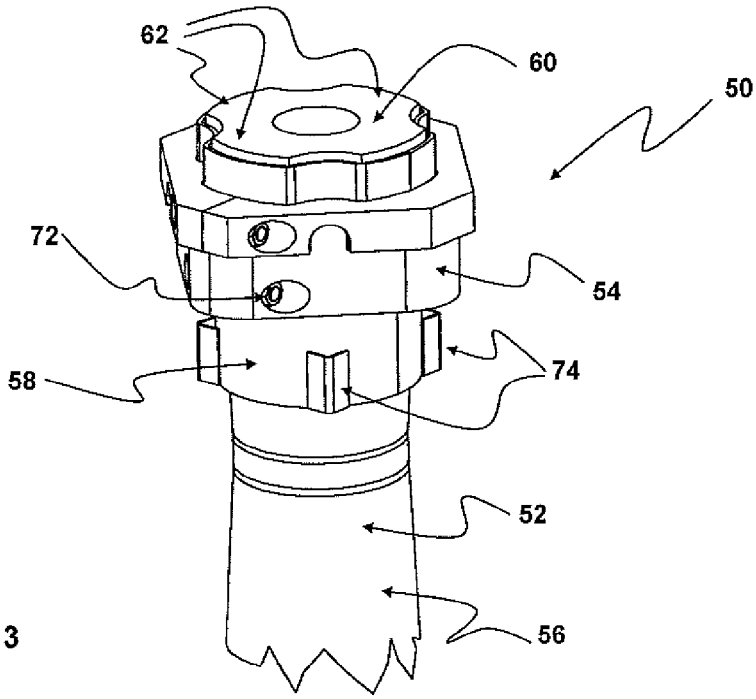
FIG. 3 is a perspective view of a casting element, comprising a ladle shroud and a frame, according to another embodiment of the invention.

A casting element according to a second embodiment of the invention will now be described using FIGS. 3 and 4.

The casting element 50 according to the second embodiment comprises a shroud 52 and a removable frame 54 made in two parts 54*a*, 54*b*, the frame configured to be, and being, placed around the head of the shroud. As in the previous embodiment, only the upper end of the casting element has been depicted in the figures.

The shroud 52 comprises a tube body 56 made of a refractory material and is equipped in an end portion of the shroud with a metallic jacket 58 made notably of steel. Like the shroud according to the previous embodiment, the shroud 52 at its upper end ends in a contact surface 60 which is planar and intended to make contact with the upstream element of the installation, namely the slide valve 20.

The shroud also comprises four radial distinctive features consisting of the projections 62 and formed in the end portion of the shroud. These projections 62 are spaced 90° apart, i.e. are configured in such a way that the cross section of the shroud does not vary when this shroud is rotated through 90°.

Figure 4:
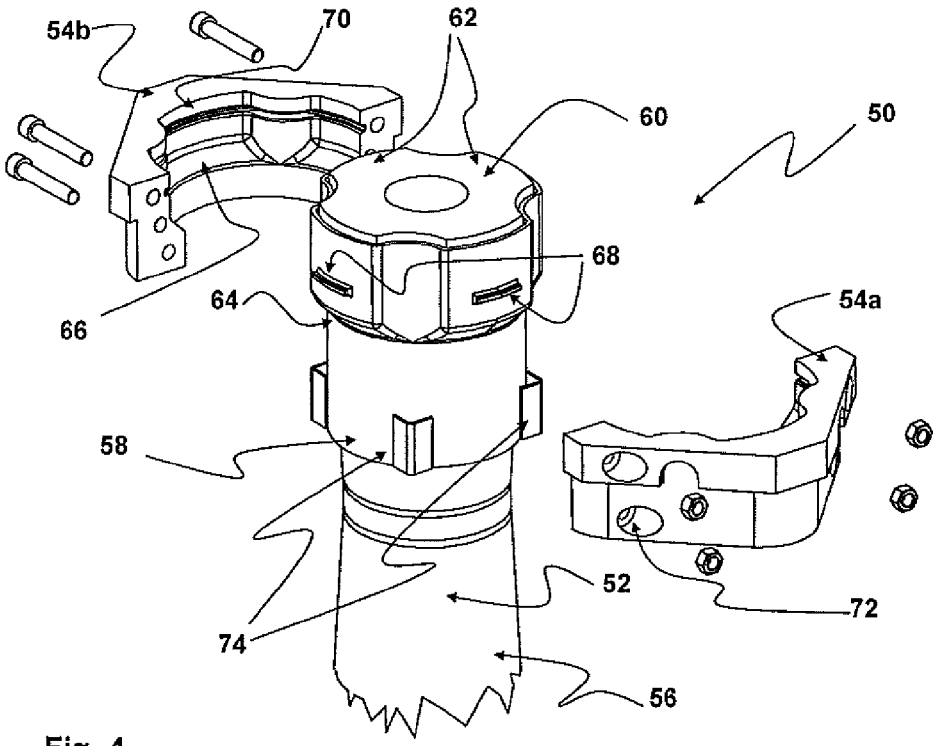
FIG. 4 is an exploded perspective view of a casting element according to FIG. 3, when the frame and the shroud are not yet assembled.

Further, as may be seen in FIG. 4, each projection 62 ends at its end distant from the contact surface 60, in control means or a chamfered surface 64 which is inclined relative to the contact surface 60. Each surface 64 is intended to rest against a complementary surface 66 belonging to the frame, likewise inclined relative to the surface 60 of the shroud when the frame and the shroud are assembled. The surfaces 64 and 66 are configured to come into abutment with one another, and come into abutment with one another, to hold the shroud in the frame.

Further, on its periphery, in each portion forming the radial distinctive feature, the shroud 52 comprises a protrusion 68. The protrusions 68 are intended to engage in control means or a continuous groove 70 of the frame when the frame and the shroud are assembled.

Each part of the frame has an internal wall of a shape that complements that of the shroud. The two removable parts 54*a*, 54*b* of the frame are screw fastened together using the orifices 72 provided for that purpose and a screw-nut system. As a result, the two parts of the frame are not fixed to the shroud but are secured to the shroud through the action of their mutual attachment means and through the collaboration between the abutment surfaces 62 of the shroud and 66 of the frame and between the protrusions 68 of the shroud and the groove 70 of the frame.

Further, because the shapes of the shroud and of the frame complement one another and because the protrusions 68 and the groove 70 are in register with one another, it is possible to determine the angle of rotation of the shroud about the central axis, relative to the frame. Specifically, the shroud can be fitted onto the frame only in certain determined orientations. The means 68-70, 66-62 therefore form means of controlling the orientation of the shroud with respect to the frame.

The frame is still fitted into the casting installation in the same way using means of controlling the orientation of the frame with respect to the upstream element, which means have not been depicted in the figure. These means for example comprise two notches similar to the notches 42, situated on two opposite sides of the frames and able to collaborate with two pins of the support.

Further, because the shroud does not vary when rotated through 90°, and because the four protrusions 62 are identical, it can be placed in the frame in four orientations spaced 90° apart.

Thus, the casting element formed by the shroud and frame assembly can be placed in the casting installation in four distinct orientations. The means 62 associated with the complementary shapes of the internal wall of the frame 54 and 68-70 and the means of controlling the orientation of the frame relative to the support form means of controlling the angular orientation of the shroud about the axis of the canal relative to the support and to the upstream element of the casting installation. These means are able to give the shroud four distinct orientations relative to the support and to the upstream element.

Further, because the surface 64 rests on the surface 66 under gravity, the regions situated between the radial protrusions 62 are under compression when the frame 54 and shroud 52 assembly is introduced into the installation. The means of checking the orientation are then arranged so that the regions most damaged by the sliding, which are the regions situated in the vicinity of the diameter of the tube extending in the direction of sliding of the shroud when the shroud is introduced into the installation, corresponds to the regions situated between the radial protrusions. These regions, because they are under compression, are in fact less damaged by the loadings due to the sliding.

It will also be noted that the metallic jacket 58 of the shroud 52 comprises four fins 74 such as the fins 44 described in the first embodiment. These fins allow the casting element to be placed on a handling device that moves the shroud into the installation. In this embodiment, the fins are situated such that they are offset in relation to the radial protrusions.

Thus, the shroud and frame assembly that forms the casting element also allows the shroud to be oriented in the casting installation in the desired manner.

The casting element is not limited to the embodiments described hereinabove.

For example, a casting element comprising a shroud and a frame in which the shroud can be fitted in just one single orientation relative to the frame, the frame being able to be introduced into the support of the installation in several orientations and relative to the upstream element thereof also form part of the invention.

Further, the shape of the control means is not limited to that described. The shroud according to the first embodiment could comprise abutment surfaces projecting from the jacket and/or notches of different shapes. Likewise, in the second embodiment, if the shroud were circular of revolution, the control means could comprise projections 68 and a housing of complementary shape formed in the frame. The number and distribution of these means is not limited to that described either.

Further, guide means such as the fins 44, 74 for positioning the shroud correctly on a handling device are optional. These means may also have different shapes from those described.

In addition, the shroud according to the first embodiment may comprise a head of a cross section other than a square cross section.

Likewise, the shroud according to the second embodiment may comprise no radial distinctive feature and be a circle of revolution. In that embodiment, the frame may also be fixed to the shroud other than by screw fastening.

Further, the shape and material of the tubes are not limited to those described above.

A method of casting according to one particular embodiment of the invention, performed with either one of the tubes of the casting elements described above will now be described.

First of all, the ladle 12 is brought over the tundish, the slide valve 20 secured to this ladle being closed at that time. The slide valve is more particularly an assembly of two superposed plates capable of sliding one relative to the other, these two plates each comprising an orifice. When the ladle 12 is brought over the tundish, the two orifices are not superposed.

Thus, because the orientation of the shroud is determined with respect to the manipulator arm, the casting element can be positioned in a first orientation with respect to an upstream element of the installation, in this instance the slide valve 20. The manipulator arm 22 then brings the casting element 30; 50 against the slide valve 20 and the two plates of the slide valve 20 are then moved so that the orifices become superimposed and the valve opens to allow the stream to enter the canal. The casting operations are then performed and the liquid metal from the ladle is therefore poured out into the tundish.

When the ladle 12 is empty, the arm 22 detaches the shroud from this ladle and the latter is moved. A new ladle can then be brought into position over the tundish.

In the case of a casting element like the one described in the second embodiment, the frame 54 is removed at this time and the orientation of the shroud 54 relative to the frame is changed.

Then, in all instances, the casting element 30; 50 is introduced into the new installation comprising the new ladle so that the shroud of the casting element 30; 52 adopts a second orientation different from the first relative to the slide valve 20. When the shroud of the casting element 30 is a shroud according to the first embodiment, the orientation of the shroud relative to the arm 22 is changed, and when the shroud is a shroud according to the second embodiment, the frame 54 is orientated in the same way relative to the arm 22.

The steps described above are repeated with the casting element 30; 50 introduced into the installation so that the shroud of the casting element 30; 52 is in the second orientation, and the same steps are then repeated a further time introducing the casting element 30; 50 in such a way that the shroud of the casting element 30; 52 is in a third orientation relative to a valve of a new casting installation. Thus, shroud wear is better distributed and the shroud can be used a greater number of times. This lengthens the life of the shroud and that allows savings to be made regarding costs associated with the tooling needed for casting methods.

The method according to the invention is not restricted to that described hereinabove either.

If the installation comprises a support belonging to the ladle for holding the shroud in the installation, the method may comprise, for each step of introducing the shroud into the installation, a step whereby a device takes hold of the shroud using the fins of the shroud, then a step whereby the shroud is positioned on the support, the shroud being orientated relative to the support using the notches 42 of the shroud or of the frame.

Numerous modifications and variations of the present invention are possible. It is therefore to be understood that, within the scope of the following claims, the invention may be practiced otherwise than as specifically described.

The invention claimed is:

1. Casting element for a casting installation for transferring liquid metal comprising a plurality of casting components in successive contact and forming a canal along which the metal can flow, the casting element comprising a tube, the axis of which corresponds to the axis of the canal, the said element being able to make contact with an upstream element of the installation, wherein the element comprises control means for controlling the angular orientation of the tube about axis of the canal with respect to the upstream element, these control means being capable of giving the tube at least three distinct orientations.

2. Casting element according to claim 1, wherein the control means are capable of giving the tube four distinct orientations, spaced 90° apart.

3. Casting element according to claim 1, wherein the tube, at an end corresponding to one end of the canal, has a surface capable of making contact with the upstream element, wherein the surface is planar.

4. Casting element according to claim 1, further comprising a removable frame configured to be placed around the tube.

5. Casting element according to claim 4, wherein the control means comprise at least one abutment surface formed on the tube and/or the frame and capable of collaborating with at least one complementary surface.

6. Casting element according to claim 4, wherein the control means comprise an abutment surface formed on the tube and an abutment surface formed on the frame, wherein the abutment surfaces are configured to come into abutment to hold the shroud in the frame.

7. Casting element according to claim 3, wherein the end of the tube comprising the contact surface is configured to have at least one radial distinctive feature, the control means being arranged on the periphery of the tube in at least one of the portions of the tube that form the distinctive feature.

8. Casting element according to claim 7, wherein the tube has at least two radial distinctive features, each distinctive feature being a projection ending in the axial direction of the tube in a chamfered surface, at a distance from the contact surface and configured to collaborate with a complementary surface belonging to the frame.

9. Casting installation for transferring metal comprising a plurality of casting components in successive contact forming a canal along which the liquid metal can flow, wherein the casting installation comprises a casting element according to claim 1.

10. Method for casting in a plurality of casting installations for transferring metal, each installation comprising a plurality of casting elements in successive contact forming a canal along which the metal can flow, the method using a casting element according to claim 1, wherein the method comprises the following steps:

introducing the casting element into a first casting installation so that the tube is placed in a first orientation about its axis with respect to an upstream element of the first installation, performing the casting operations, removing the casting element from the first installation, repeating the previous three steps with the casting element placed respectively in a second and then in a third installation so that the tube is placed respectively in a second and then in a third orientation about its axis with respect to an upstream element of the second and the third installation.

* * * * *